US009979120B2

(12) United States Patent
Fujimura

(10) Patent No.: US 9,979,120 B2
(45) Date of Patent: May 22, 2018

(54) CONNECTOR

(71) Applicant: Sumitomo Wiring Systems, Ltd., Yokkaichi, Mie (JP)

(72) Inventor: Mizuho Fujimura, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days. days.

(21) Appl. No.: 15/542,661

(22) PCT Filed: Dec. 24, 2015

(86) PCT No.: PCT/JP2015/085918
§ 371 (c)(1),
(2) Date: Jul. 11, 2017

(87) PCT Pub. No.: WO2016/114085
PCT Pub. Date: Jul. 21, 2016

(65) Prior Publication Data

US 2017/0358887 A1 Dec. 14, 2017

(30) Foreign Application Priority Data

Jan. 14, 2015 (JP) ..... 2015-004989

(51) Int. Cl.
*H01R 13/62* (2006.01)
*H01R 13/56* (2006.01)
(Continued)

(52) U.S. Cl.
CPC ..... *H01R 13/56* (2013.01); *H01R 13/506* (2013.01); *H01R 13/516* (2013.01);
(Continued)

(58) Field of Classification Search
CPC .... H01R 13/56; H01R 13/506; H01R 13/516; H01R 13/62944; H01R 13/62977; H01R 13/62955
(Continued)

(56) References Cited

U.S. PATENT DOCUMENTS 6,832,922 B2 * 12/2004 Kozono ..... H01R 13/447 439/135
8,197,271 B2 * 6/2012 Kobayashi ..... H01R 13/62955 439/157
(Continued)

FOREIGN PATENT DOCUMENTS

| | | |
|---|---|---|
| JP | 7-47819 | 11/1995 |
| JP | 2003-272768 | 9/2003 |
| JP | 2014-99267 | 5/2014 |

OTHER PUBLICATIONS

International Search Report dated Mar. 22, 2016.

*Primary Examiner* — Khiem Nguyen
(74) *Attorney, Agent, or Firm* — Gerald E. Hespos; Michael J. Porco; Matthew T. Hespos

(57) ABSTRACT

A connector includes a connector housing 10 provided with cavities 13 for accommodating terminal fittings and connectable to a mating connector, a cover 50 configured to cover wires pulled out from the connector housing 10 by being mounted on a cover mounting surface 10A side of the connector housing 10 opposite to a connection surface, locking pieces 55 deflectably provided on both side surfaces of the cover 50 and configured to lock the cover 50 to the connector housing 10 by projecting toward the connector housing 10, and protection walls 37 provided on the connector housing 10, the other locking piece 55 coming into contact with the protection wall 37 when being pushed in an unlocking direction when one of the locking pieces 55 is unlocked and the cover 50 is inclined with respect to the connector housing 10.

4 Claims, 16 Drawing Sheets

(51) Int. Cl.
*H01R 13/506* (2006.01)
*H01R 13/516* (2006.01)
*H01R 13/629* (2006.01)

(52) U.S. Cl.
CPC . *H01R 13/62944* (2013.01); *H01R 13/62977* (2013.01); *H01R 13/62955* (2013.01)

(58) Field of Classification Search
USPC ..... 439/157, 345, 350, 357
See application file for complete search history.

(56) References Cited

U.S. PATENT DOCUMENTS

| | | | | |
|---|---|---|---|---|
| 8,721,373 | B2 * | 5/2014 | Suzuki ..... | H01R 13/506<br>439/589 |
| 2003/0176090 | A1 | 9/2003 | Kozono et al. | |
| 2014/0134862 | A1 | 5/2014 | Itou et al. | |

* cited by examiner

CONNECTOR

BACKGROUND

1. Field of the Invention

This specification relates to a connector.

2. Description of the Related Art

A cover may be mounted on a connector housing to change a pull-out direction of wires pulled out from the connector housing. For example, Japanese Unexamined Patent Publication No. 2014-99267 discloses a connector with a connector housing provided with cavities for accommodating terminal fittings and a cover to be mounted on the connector housing. The connector housing is laterally long and the cavities are arranged in a long side direction of the connector housing. The cover has a guide that fits to a guide receiving portion provided in the long side direction of the connector housing. The guide is moved in the guide receiving portion as the cover is mounted on the connector housing. Then, resiliently deformable mounting pieces provided on the cover are locked to the connector housing to mount the cover at a predetermined position.

The cover of the connector shown in Japanese Unexamined Patent Publication No. 2014-99267 can be removed by displacing the cover to incline sufficiently in one direction to deform a mounting piece on one side toward the cavities and then using a tool to deform the mounting piece on the other side resiliently toward the cavities so that a locked state is released. However, the mounting pieces may be pushed excessively toward the cavities and broken.

SUMMARY

A connector disclosed in this specification includes a connector housing provided with a cavity for accommodating at least one terminal fitting. The connector is connectable to a mating connector. A cover is configured to cover a wire pulled out from the connector housing by being mounted on a cover mounting surface side of the connector housing opposite to a connection surface. Deflectable locking pieces are provided on both side surfaces of the cover and are configured to lock the cover to the connector housing by projecting toward the connector housing. The cover can be inclined with respect to the connector housing so that a first one of the locking pieces is unlocked. A protection wall is provided on the connector housing, and the other locking piece contacts the protection wall when being pushed in an unlocking direction.

According to this configuration, a locking piece that is pushed to be unlocked contacts the protection wall and is not deflected to a degree more than specified. Thus, the locking piece is not deflected excessively and broken. Additionally, when only one locking piece is unlocked and the cover is inclined with respect to the connector housing, the locking piece reliably contacts the protection wall to ensure that the locking piece is not deflected more than expected and broken.

The connector housing may include a slide guide configured to slide and mount the cover in a direction intersecting with a connecting direction to the mating connector and a stopper configured to regulate an end position of a sliding movement and to be located inside the cover. The protection wall may be integral to the stopper. According to this configuration, the strength of the protection wall can be increased by connecting the protection wall to the stopper.

A plurality of wire accommodating tubes connected to the cavities may be provided on the cover mounting surface of the connector housing, and the protection wall may be integrated with a reinforcing rib that links the wire accommodating tubes. According to this configuration, the protection wall is reinforced by the reinforcing rib integrally provided to the wire accommodating tubes so that the strength of the protection wall can be increased.

According to the connector disclosed in this specification, excessive deflection of the locking pieces can be suppressed.

DETAILED DESCRIPTION

An embodiment is described below with reference to FIGS. 1 to 16.

Figure 1:
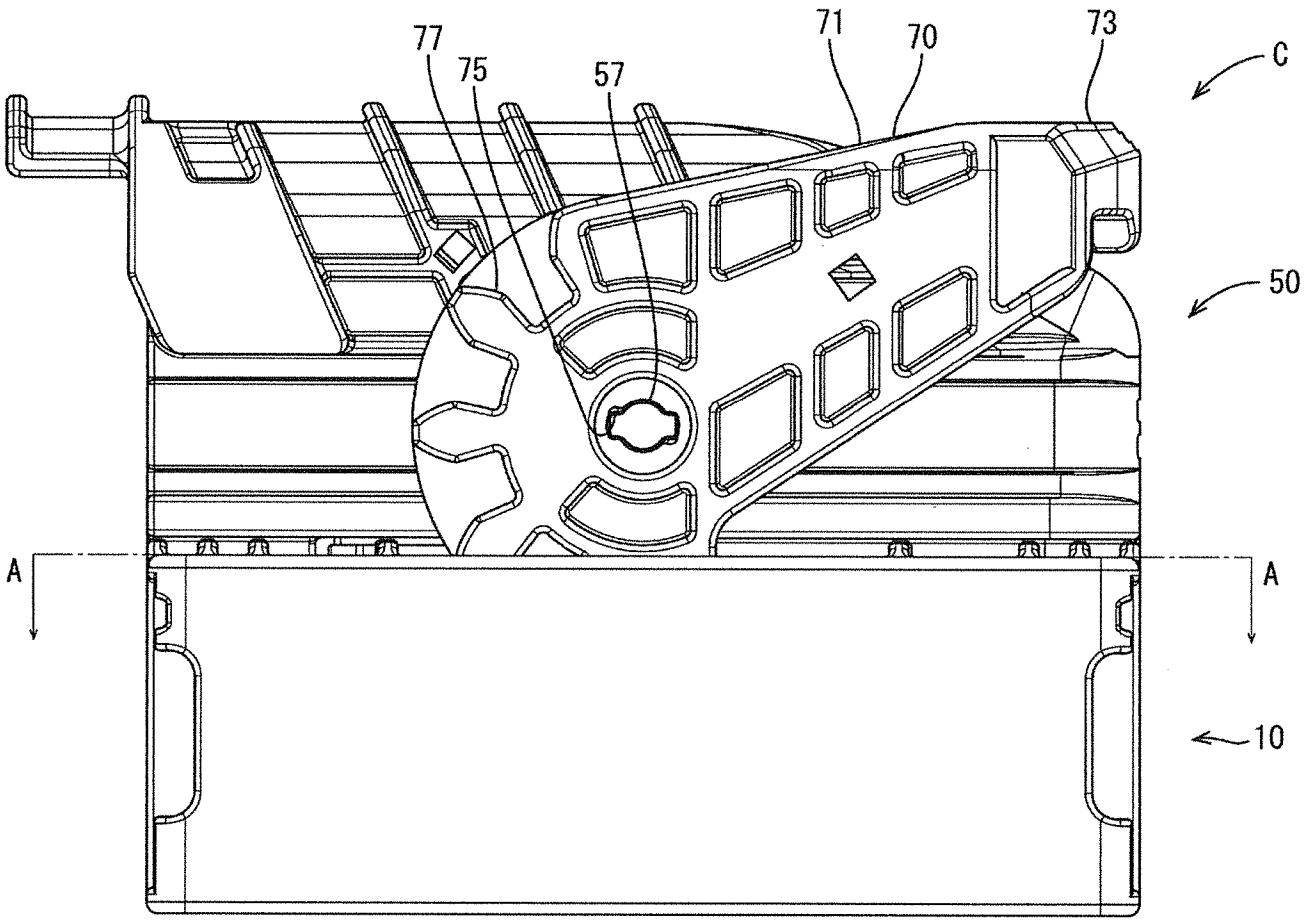
FIG. 1 is a front view of a connector according to an embodiment.

A connector C of this embodiment includes a female connector housing 10 and a cover 50 for covering wires pulled out from the connector housing 10 as shown in FIG. 1. In the following description, a connecting direction and a separating direction of the connector C and a mating connector are referred to as a forward direction and a rearward direction concerning a front-rear direction, a lateral direction is based on FIG. 1 and a vertical direction is based on FIG. 7.

Figure 4:
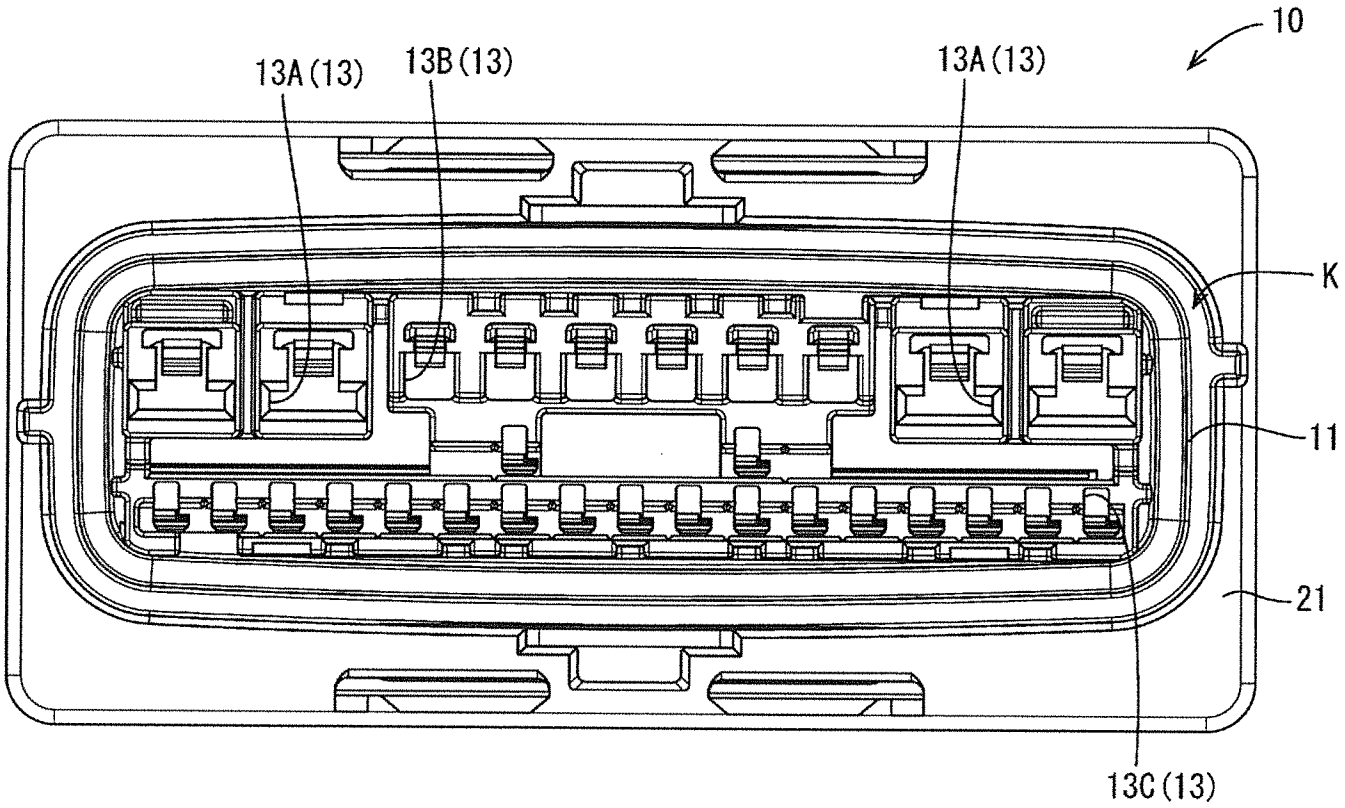
FIG. 4 is a view of a connector housing viewed from a connection surface side.

The connector housing 10 is made of synthetic resin and shaped to be long in the lateral direction. Further, as shown in FIG. 4, the connector housing 10 includes a connector housing body 11 formed with cavities 13 capable of accommodating terminal fittings, and an outer peripheral portion 21 in the form of a rectangular tube provided on the outer periphery of the connector housing body 11. A space between the connector housing body 11 and the outer peripheral portion 21 serves as a connection space K into which the mating connector is inserted at the time of connection.

The cavity 13 is open in the connecting direction (both forward and rearward directions), the terminal fitting is inserted thereinto from behind (side opposite to a connection surface), and a mating terminal fitting accommodated in the mating connector is insertable thereinto from front, i.e. from the side of the connection surface. As shown in FIG. 4, three types of cavities 13 differing in size are provided. More particularly, large-size cavities 13A are arranged side by side in upper parts of both end parts of a long side of the connector housing body 10, and medium-size cavities 13B for accommodating medium-size terminal fittings are arranged in an area between these large-size cavities 13A. Further, small-size cavities 13C for accommodating small-size terminal fittings are arranged above the medium-size and large-size cavities 13B, 13A. Note that, in the following description, the cavities 13A to 13C are referred to as the cavities 13 when a common configuration is described.

Figure 5:
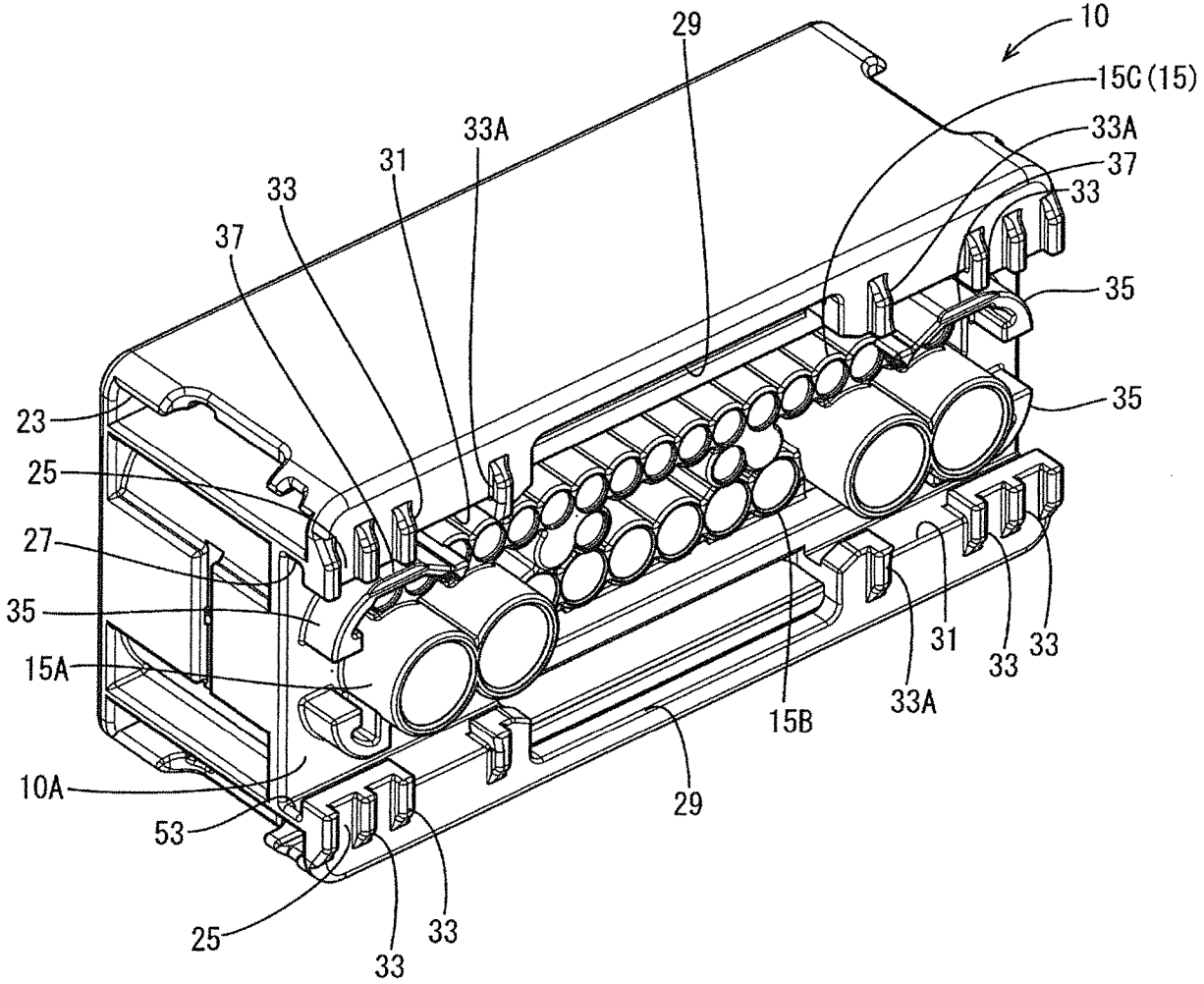
FIG. 5 is a perspective view of the connector housing.
Figure 6:
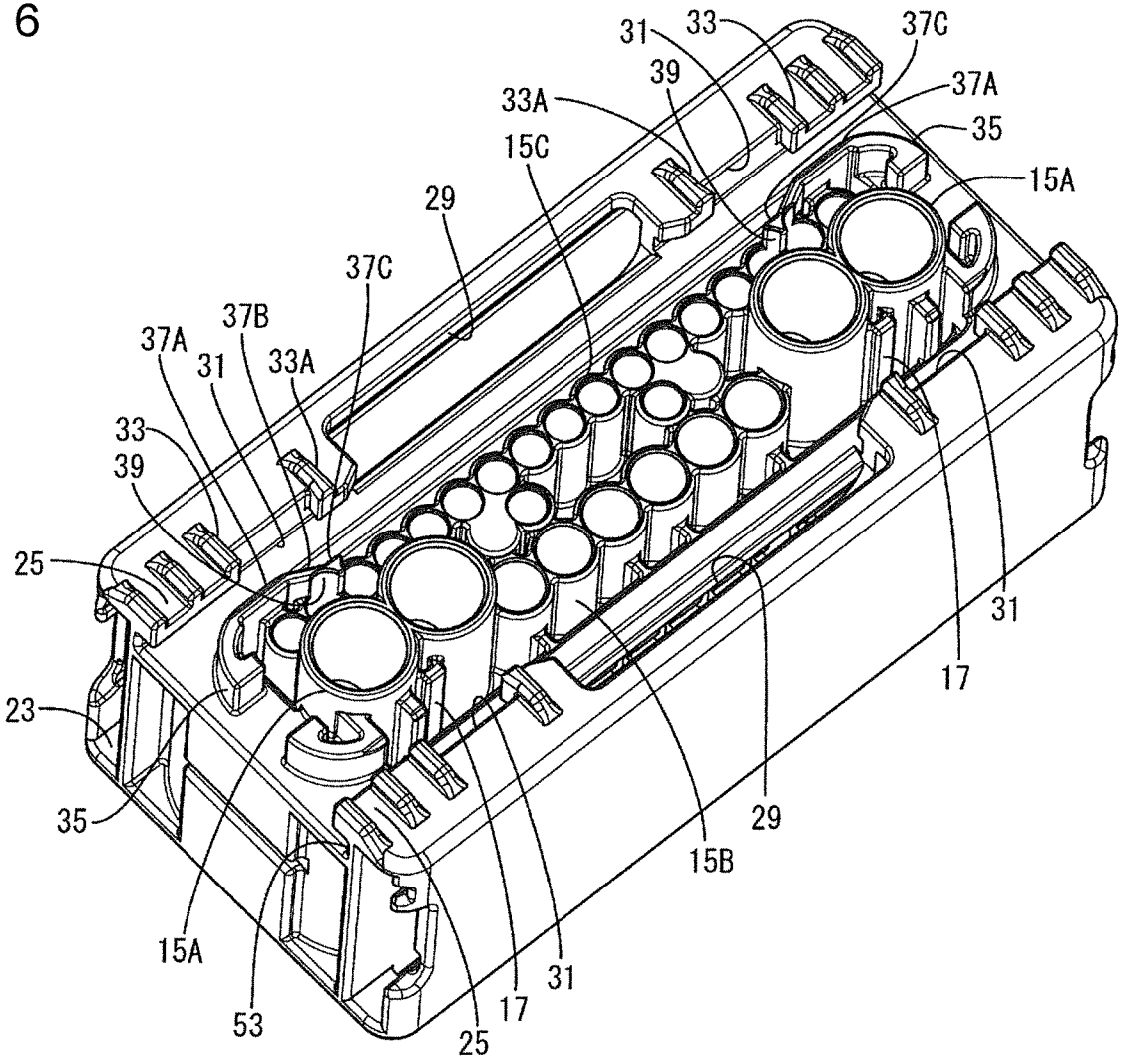
FIG. 6 is a perspective view of the connector housing.

As shown in FIG. 5, cylindrical wire accommodating tubes 15 are provided to project from a rear surface 10A of the connector housing 10 to be connected to the respective cavities 13. Similar to the cavities 13, three types of wire accommodating tubes 15 differing in size are provided, and the wire accommodating tubes 15A to 15C are provided in accordance with the respective cavities 13A to 13C. Further, as shown in FIG. 6, protective ribs 17 integrated with the large-size wire accommodating tubes 15A are provided between adjacent ones of the large-size wire accommodating tubes 15A.

Figure 3:
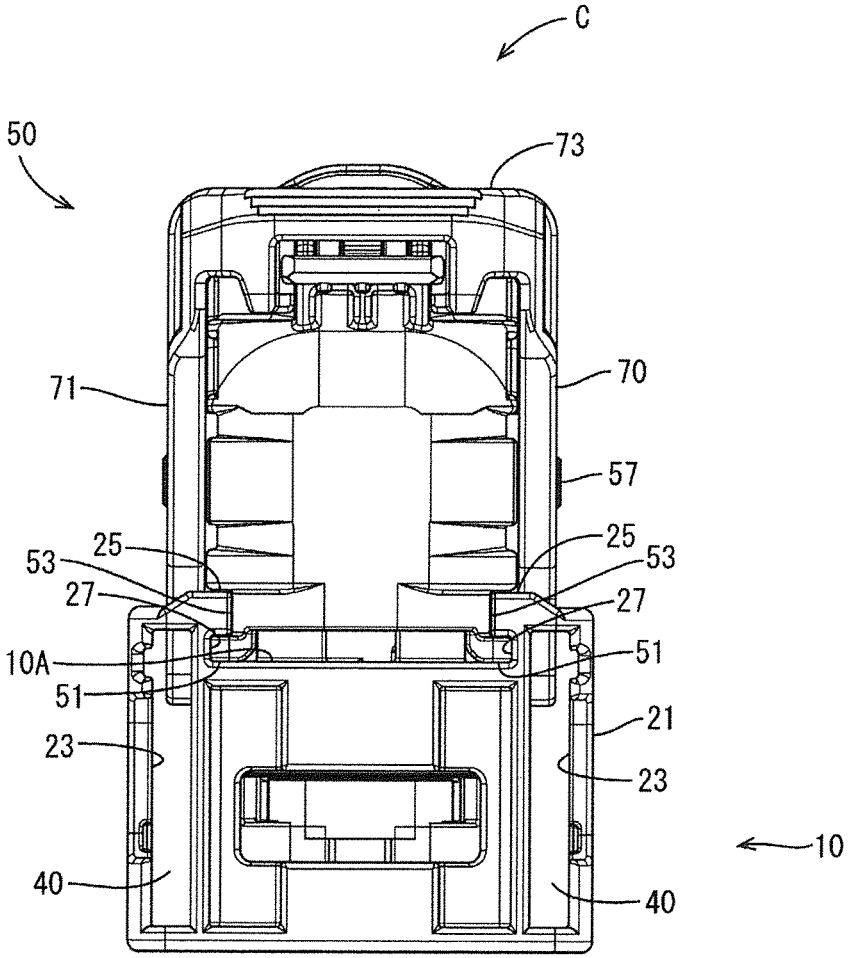
FIG. 3 is a side view of the connector.

As shown in FIG. 3, both long sides of the outer peripheral portion 21 have a hollow structure formed by inner and outer walls. This hollow portion serves as a slider accommodating chamber 23 for accommodating a slider 40 in the form of a flat plate. Both end parts on the long sides of the both slider accommodating chambers 23 are open so that the sliders 4 can be inserted selectively through both openings. Upper edge parts of wall surfaces constituting the slider accommodating chambers 23 serve as protruding portions 25 that protrude farther up than the upper surface of the connector housing body 11. Two guide receiving portions 27 are formed in the vertical direction (lateral direction in FIG. 3) to face each other on inner (front) wall surfaces of these protruding portions 25. The guide receiving portions 27 are formed along the lateral direction of the connector housing 10 and are provided by forming grooves between the protruding portions 25 and the rear surface 10A of the connector housing 10.

Figure 7:
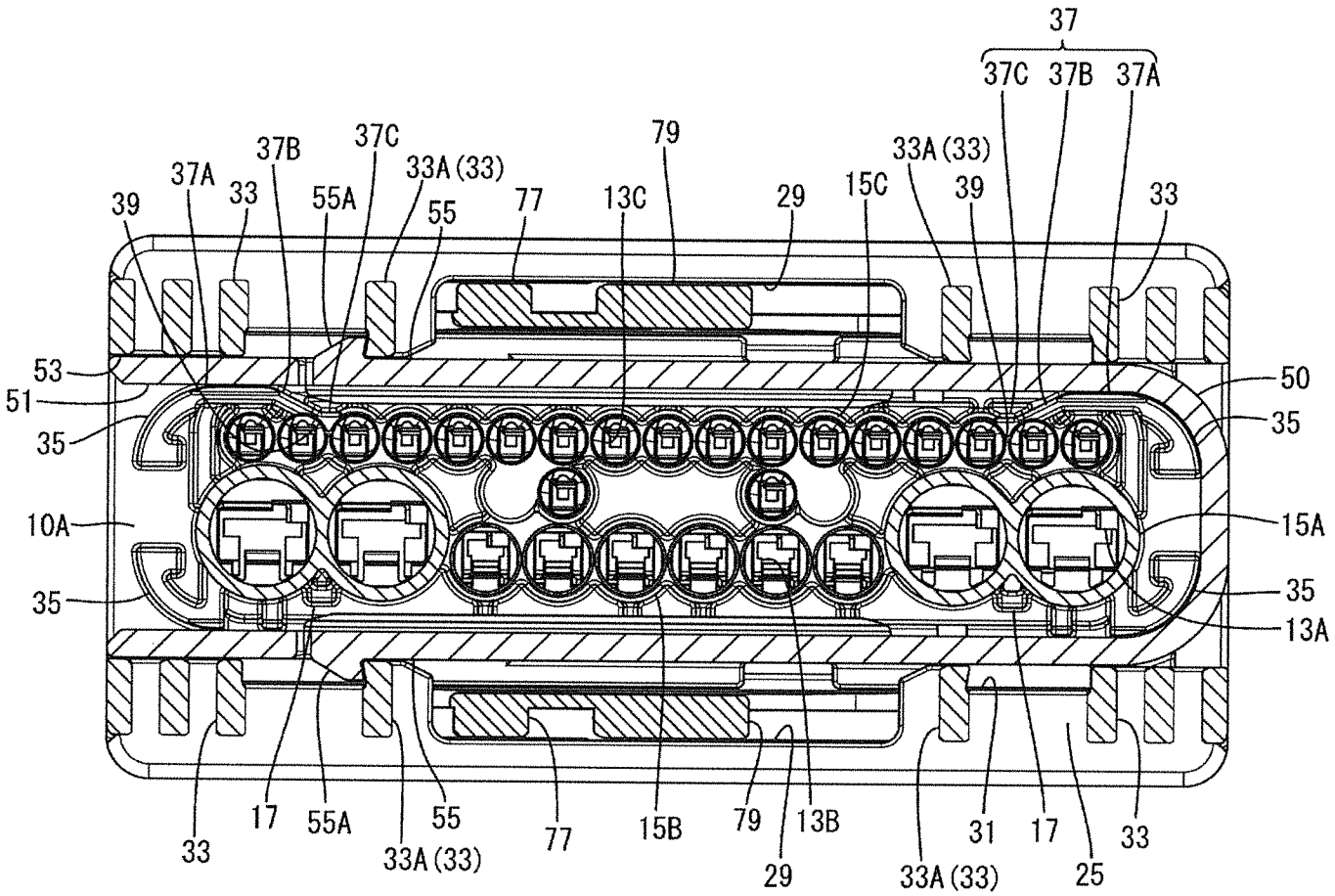
FIG. 7 is a section along A-A in FIG. 1.

As shown in FIGS. 5, 7, the protruding portion 25 is cut substantially in the entire range in a protruding direction and over a predetermined width range in a lateral central part, thereby forming a cut 29. Gears 77 formed on a lever 70 (see FIG. 1) provided on the cover 50 to be described later are insertable into the slider accommodating chambers 23 through these cuts 29.

Further, as shown in FIGS. 5, 7, the protruding portion 25 is cut at bilaterally symmetrical positions across the cut 29, thereby forming a pair of escaping portions 31. The escaping portions 31 have a shorter longitudinal length than the cut 29 and, as shown in FIGS. 5, 7, two projecting edges 33 project rearward on left and right opening edges of the escaping portion 31.

Further, as shown in FIGS. 5, 7, two stoppers 35 project rearward while being spaced apart in a short side direction on each of both left and right end parts of the rear surface 10A of the connector housing 10. As shown in FIG. 7, the stoppers 35 come into contact with a short side inner surface of the cover 50 to obstruct a movement of the cover 50 in one direction (leftward direction in FIG. 7) when the cover 50 is assembled in a proper state with the connector housing 10.

As shown in FIG. 7, protection walls 37 integrally extend from upper end parts of the upper stoppers 35 in the long side direction (direction toward a center of the connector housing 10). The protection wall 37 includes a coupling portion 37A connected to the stopper 35 in parallel to a side surface of the cover 50 assembled in the proper state to be described later, an inclined portion 37B oblique to the coupling portion 37A to extend toward a rear side (side of the wire accommodating tubes 15) from the coupling portion 37A and a reinforcing portion 37C integrated with a triangular reinforcing rib 39 parallel to the side surface of the cover 50 assembled in the proper state to be described later and linking between adjacent ones of the wire tubular portions 15C. The reinforcing rib 39 projects farther rearward than the wire accommodating tubes 15 and is at the same height as the stopper 35 and the protection wall 37. Note that a space into which a locking piece 55 to be described later is deflectable is provided between the protection wall 37 and the projecting edges 33, and a locking projection 55A can pass between the protection wall 37 and the projecting edges 33 in a state where the locking piece 55 is deflected.

As shown in FIG. 1, the cover 50 is shaped to cover the connector housing 10 from behind, and is open in a surface on a side facing the connector housing 10 (front side) and a left side surface shown in FIG. 1. The cover 50 can accommodate a bundle of wires pulled out from the upper surface of the connector housing 10 inside. The cover 50 can be mounted on the connector housing 10 with a lateral orientation changed, thereby exhibiting a function of selectively changing a wire routing direction in accordance with a mounting direction of the cover 50

As shown in FIG. 3, guides 51 are provided along the longitudinal direction on lower edge parts of both longitudinal side surfaces of the cover 50. The guiding portions 51 are movable along the guide receiving portions 27 by fitting the guides 51 into the guide receiving portions 27 of the connector housing 10. Further, a sliding groove 53 integrated with the rear surface of the guide 51, open outward and having a substantially C-shaped cross-section is formed behind the guide 51. The sliding groove 53 is fit to the protruding portion 25 of the connector housing 10 to be movable along this protruding portion 25. That is, the guides 51 can guide the cover 50 in a direction perpendicular to the connecting direction with the guides 51 fit in the guide receiving portions 27 and the protruding portions 25 fit in the sliding grooves 53.

Further, as shown in FIG. 7, the locking piece 55 is provided in a lateral orientation at a somewhat leftward position in a central part in the sliding groove 53. The locking piece 55 is cantilevered along the lateral direction and formed to be deflectable in a thickness direction (short side direction of the cover 50). The locking piece 55 includes the locking projection 55A projecting outward (in the front-rear direction), and the cover 50 is locked to the connector housing 10 by locking the locking projections 55A to the projecting edges 33A on a central side in the long side direction.

As shown in FIG. 1, two support shafts 57 for mounting the lever 70 are formed integrally to project on both longitudinal side surfaces of the cover 50. A right side of the upper surface of the cover 50 in FIG. 1 is formed to be moderately sloped down to avoid interference when the lever 70 is at a standby position, and a lever lock portion 59 (see FIG. 2) for locking the lever 70 at the standby position projects at a right end part of this upper surface.

Figure 2:
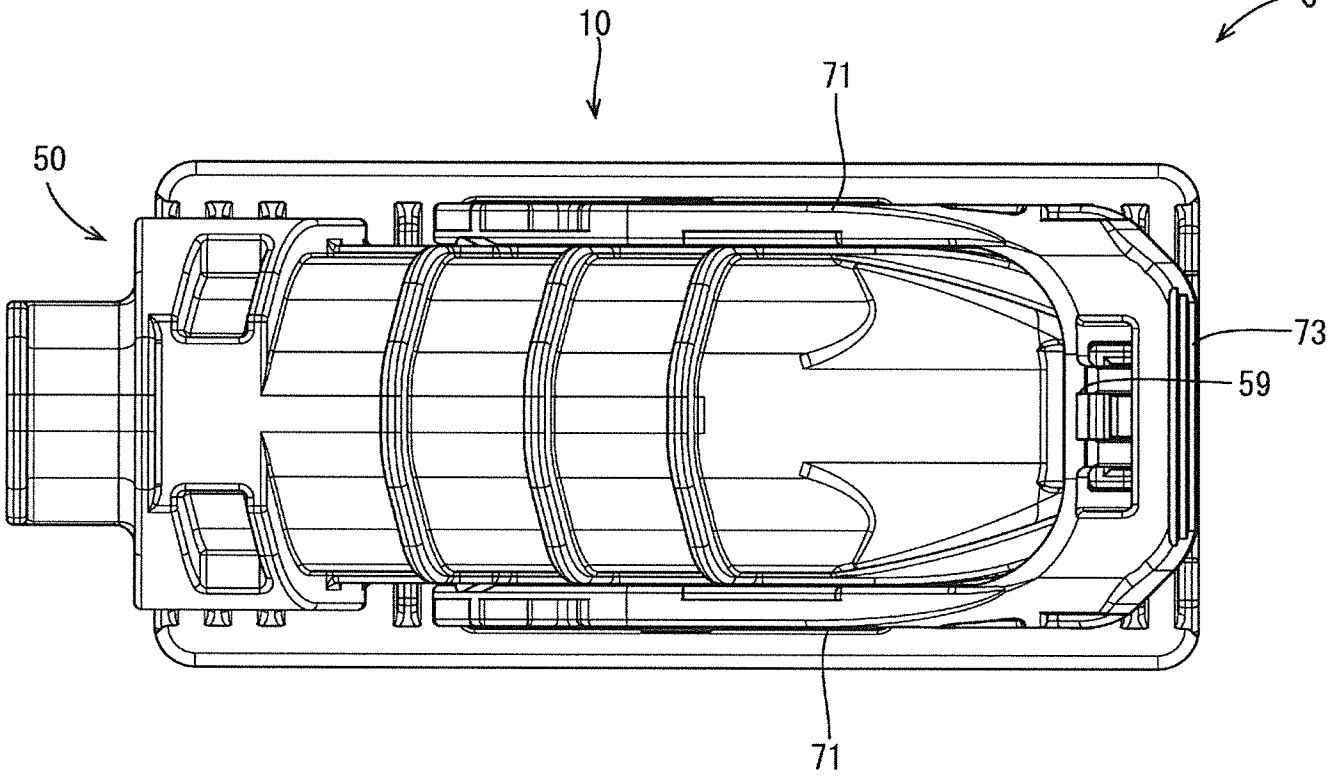
FIG. 2 is a plan view of the connector.

As shown in FIGS. 1, 2, the lever 70 is composed of a pair of side plates 71 and an operating portion 73 coupling tip parts of both side plates 71. Mounting holes 75 penetrate through central parts of the side plates 71 and are fit to the support shafts 57 so that the lever 70 in a retained state is rotatable about the support shafts 57.

The outer edge of the side plate 71 of the lever 70 is formed into an arcuate shape centered on a center of rotation of the lever 70. Further, a total of three gears 77 are engraved at uniform intervals on a peripheral edge part of an outer surface side of each of the side plates 71 while leaving a material on an inner surface side. Further, stopper teeth 79 are formed on the same peripheral surfaces as the respective gears 77. These stopper teeth 79 (see FIG. 7) are in contact with rack teeth provided on rear edge parts of the sliders 40 when the lever 70 is at the standby position, thereby obstructing movements of the slider 40 so that the sliders 40 do not move inadvertently.

Next, how to remove the cover 50 from the connector housing 10 is described using FIGS. 7 to 16. As shown in FIG. 7, when the cover 50 is mounted in a proper state on the connector housing 10, two locking projections 55A of the cover 50 lock the projecting edges 33A on the central side of the connector housing 10, thereby suppressing a movement of the cover 50 to a right side shown in FIG. 7. Further, the inner wall on the short side of the cover 50 comes into contact with the stopper portions 35, thereby suppressing a movement of the cover 50 to a left side shown in FIG. 7. The guides 51 and the sliding grooves 53 of the cover 50 are fit to the guide receiving portions 27 and the protruding portions 25 of the connector housing 10 so that a vertical movement of the cover 50 also is suppressed.

Figure 8:
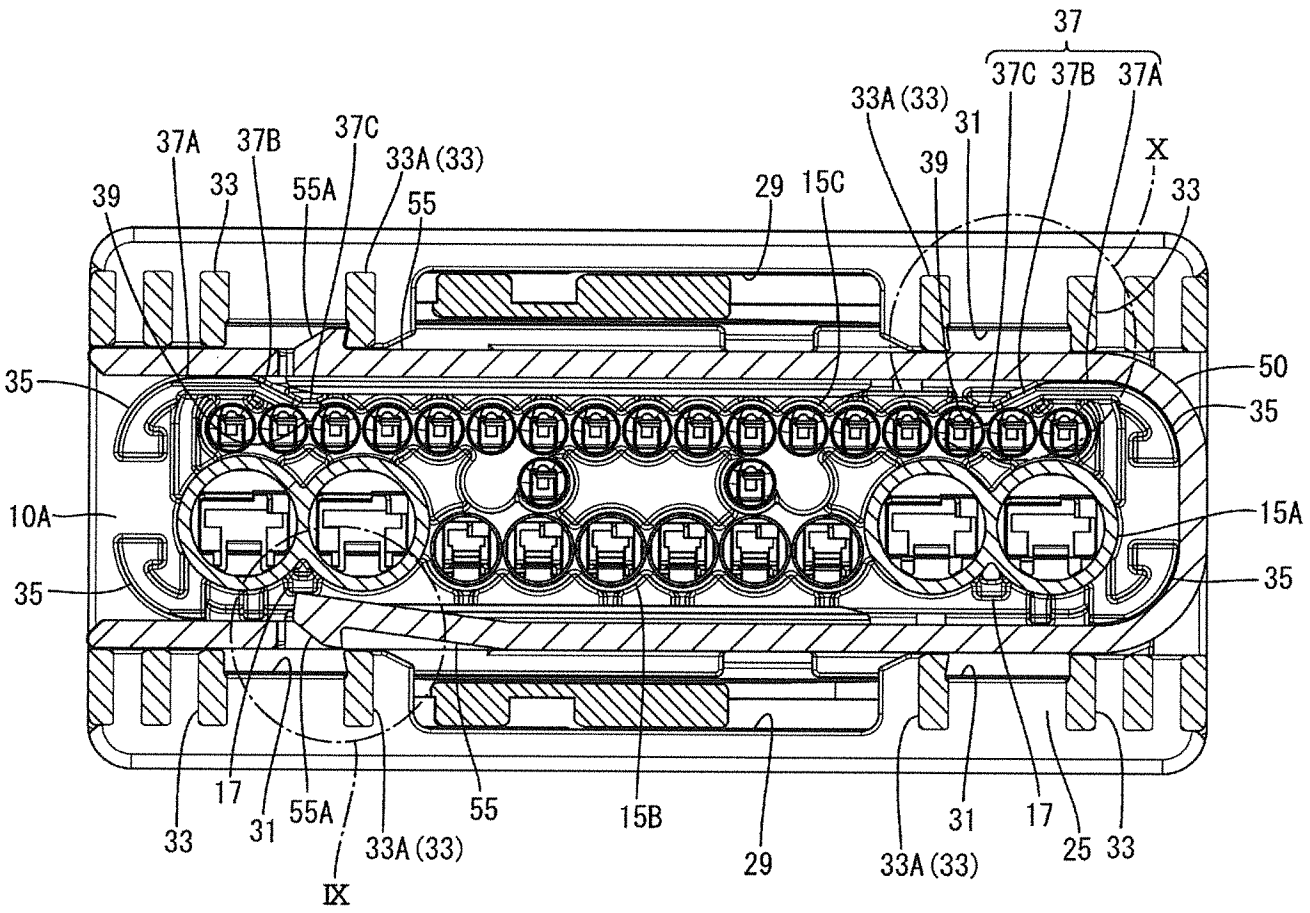
FIG. 8 is a section along A-A in FIG. 1 showing a state where one locking piece is unlocked by a tool.
Figure 9:
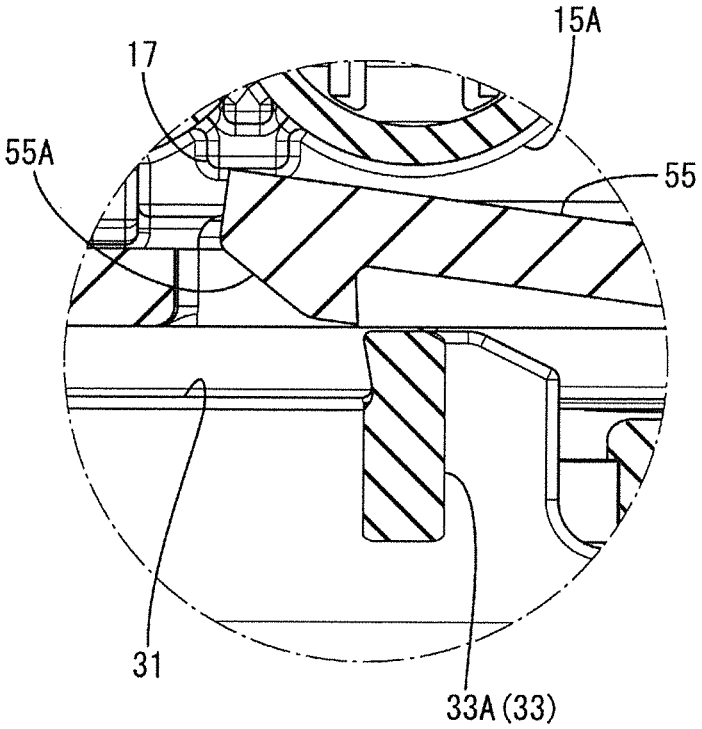
FIG. 9 is a partial enlarged section at a position IX in FIG. 8.
Figure 10:
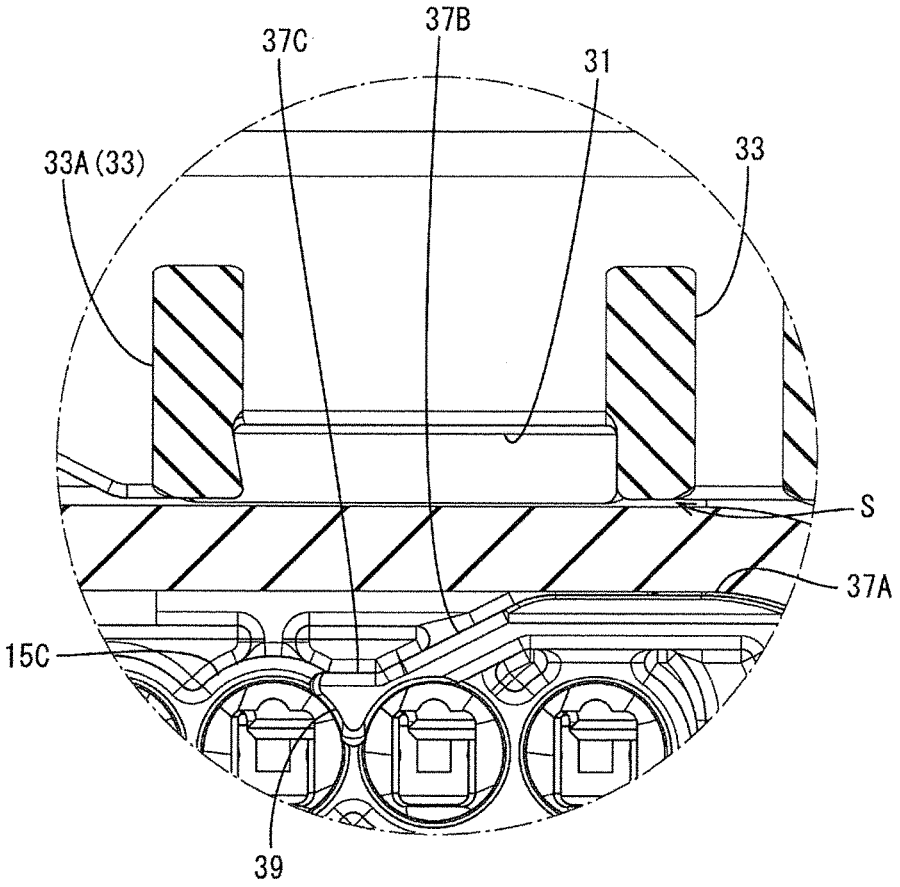
FIG. 10 is a partial enlarged section at a position X in FIG. 8.

To remove the cover 50 from the connector housing 10 from this state, the cover 50 needs to be enabled to move rightward. First, the lower (side of the wire accommodating tubes 15A) locking projection 55A is pushed in (up) by a tool as shown in FIG. 8. Thus, the locking piece 55 is deflected and the locking projection 55A is disengaged from the lower projecting edge 33A on the central side as shown in FIG. 9. Note that excessive deflection of the locking piece 55 is suppressed by the locking piece 55 coming into contact with the protection rib 17. Further, in this state, a clearance S is provided between a right-upper part of the cover 50 and the projecting edges 33 as shown in FIG. 10. This clearance S is provided to allow molding errors and the like of the connector housing 10 and the cover 50.

Figure 11:
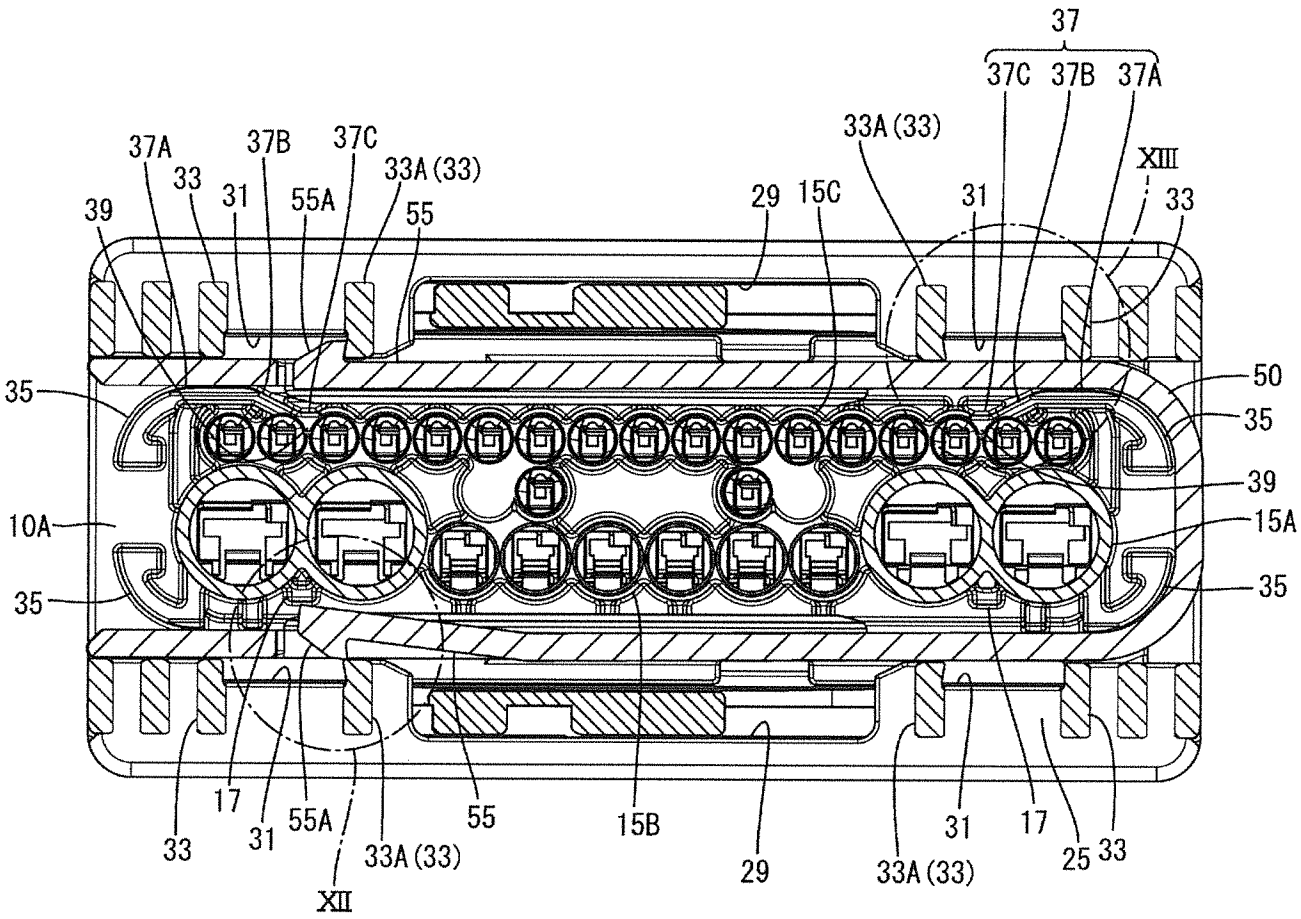
FIG. 11 is a section along A-A in FIG. 1 showing a state where a cover is inclined with respect to the connector housing with the one locking piece unlocked.
Figure 12:
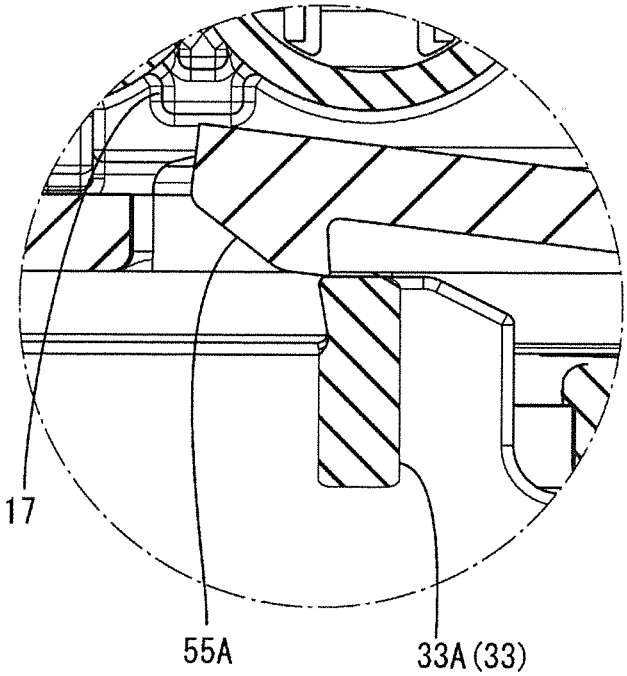
FIG. 12 is a partial enlarged section at a position XII in FIG. 11.
Figure 13:
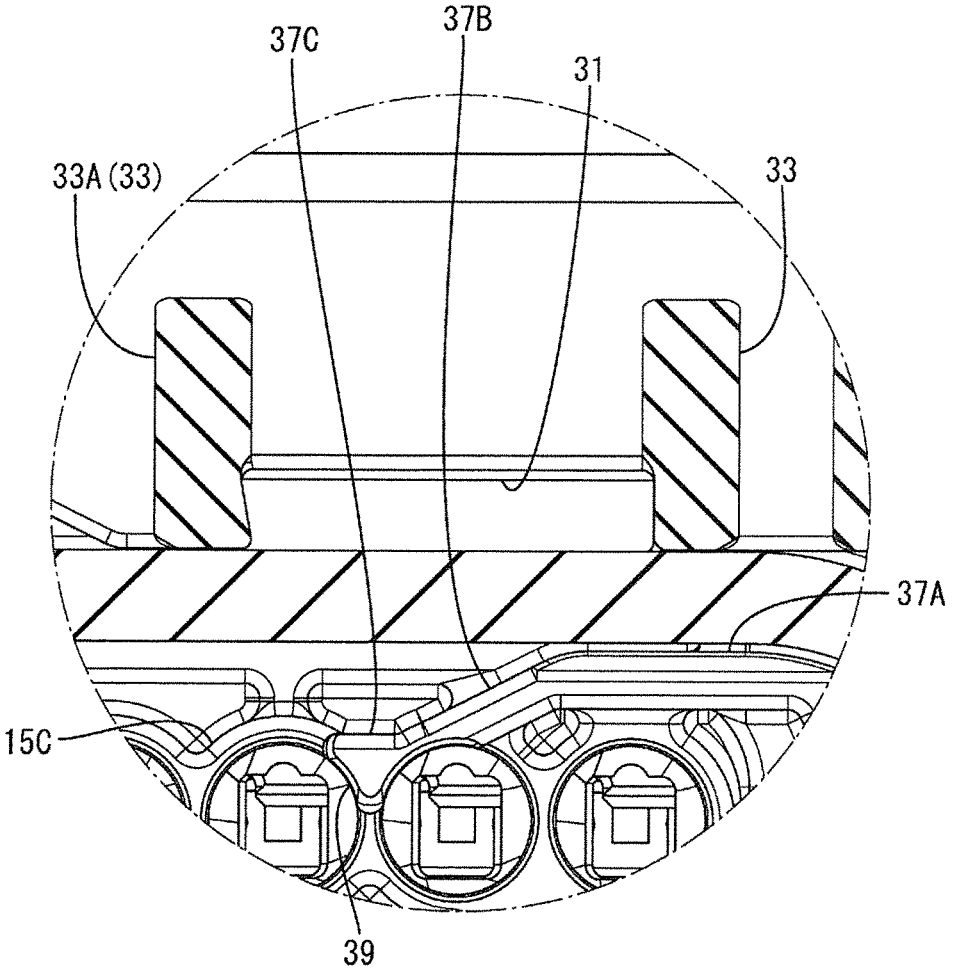
FIG. 13 is a partial enlarged section at a position XIII in FIG. 11.

As shown in FIG. 8, the lower locking projection 55A is inclined slightly toward to a right-upper side to fill up the clearance S on the right-upper side as shown in FIG. 11 from the state where the lower locking projection 55A is disengaged from the projecting edge 33A on the central side. Specifically, as shown in FIG. 13, the clearance S between the connector housing 10 and the cover 50 is eliminated on the right-upper side and the cover 50 is in contact with the projecting edges 33 of the connector housing 10. By inclining the cover 50 with respect to the connector housing 10 in this way, the lower locking projection 55A is held over the projecting edge 33A on the central side as shown in FIG. 12.

Figure 14:
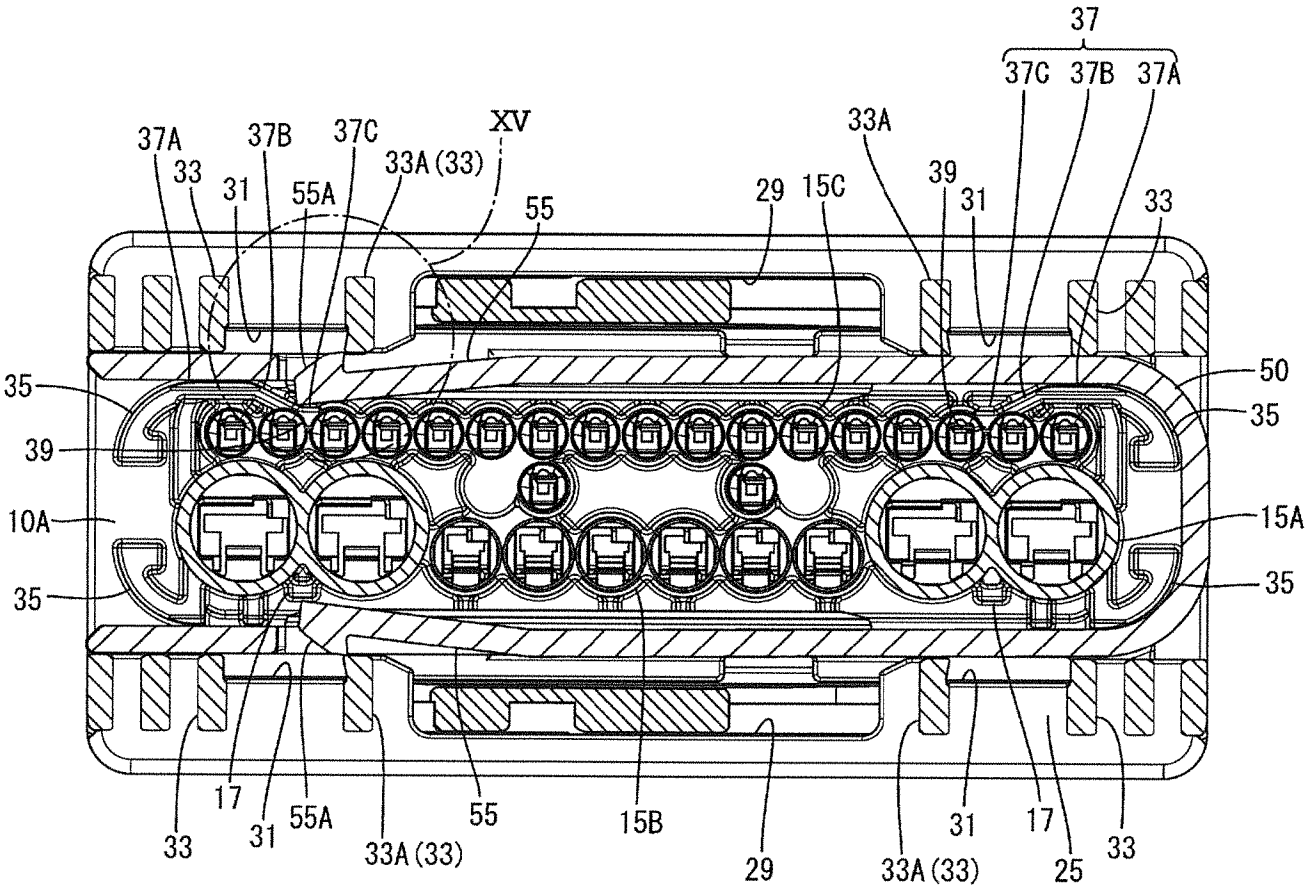
FIG. 14 is a section along A-A in FIG. 1 showing a state where the other locking piece is unlocked by the tool.
Figure 15:
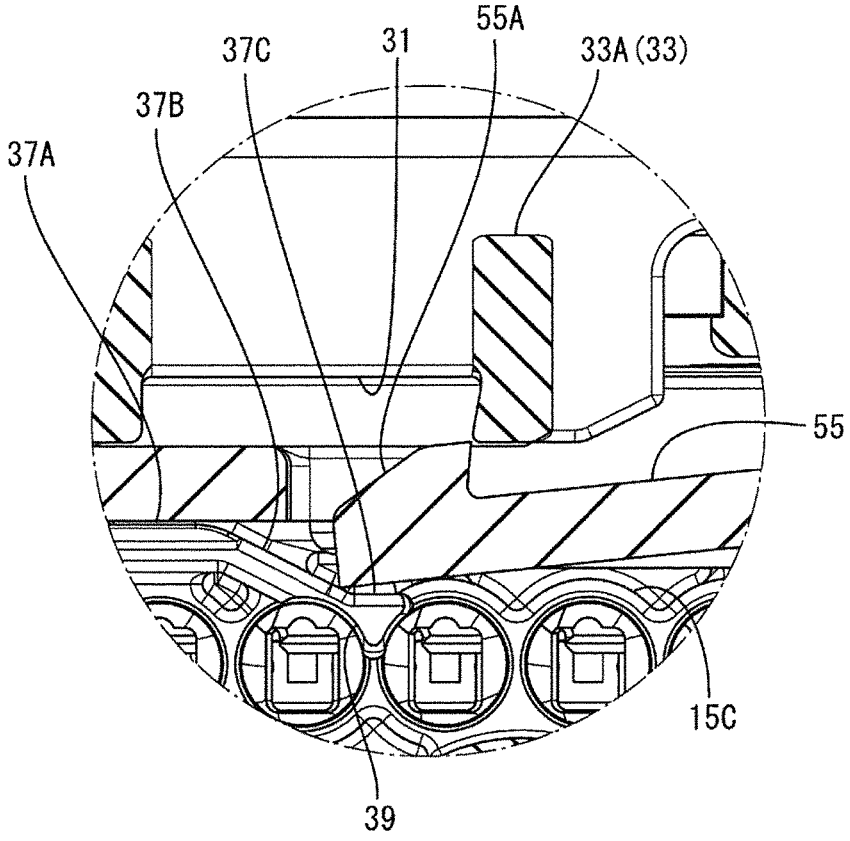
FIG. 15 is a partial enlarged section at a position XV in FIG. 14.

The upper (side of the wire accommodating tubes 15C) locking projection 55A is pushed in (down) by the tool, as shown in FIG. 14, when the lower locking piece 55 is unlocked and the cover 50 is inclined with respect to the connector housing 10 in this way. Thus, the locking piece 55 is deflected and the locking projection 55A is disengaged from the upper projecting edge 33A on the central side, as shown in FIG. 15. At this time, a tip part of the locking piece 55 is pressed by the tool, and the locking piece 55 is deflected along the inclined portion 37B of the protection wall 37, but stops deflection by coming into contact with the reinforcing portion 37C. That is, excessive deflection of the locking piece 55 is suppressed by the locking piece 55 coming into contact with the protection wall 37 when the locking piece 55 is pushed in an unlocking direction (inward) by the tool.

Figure 16:
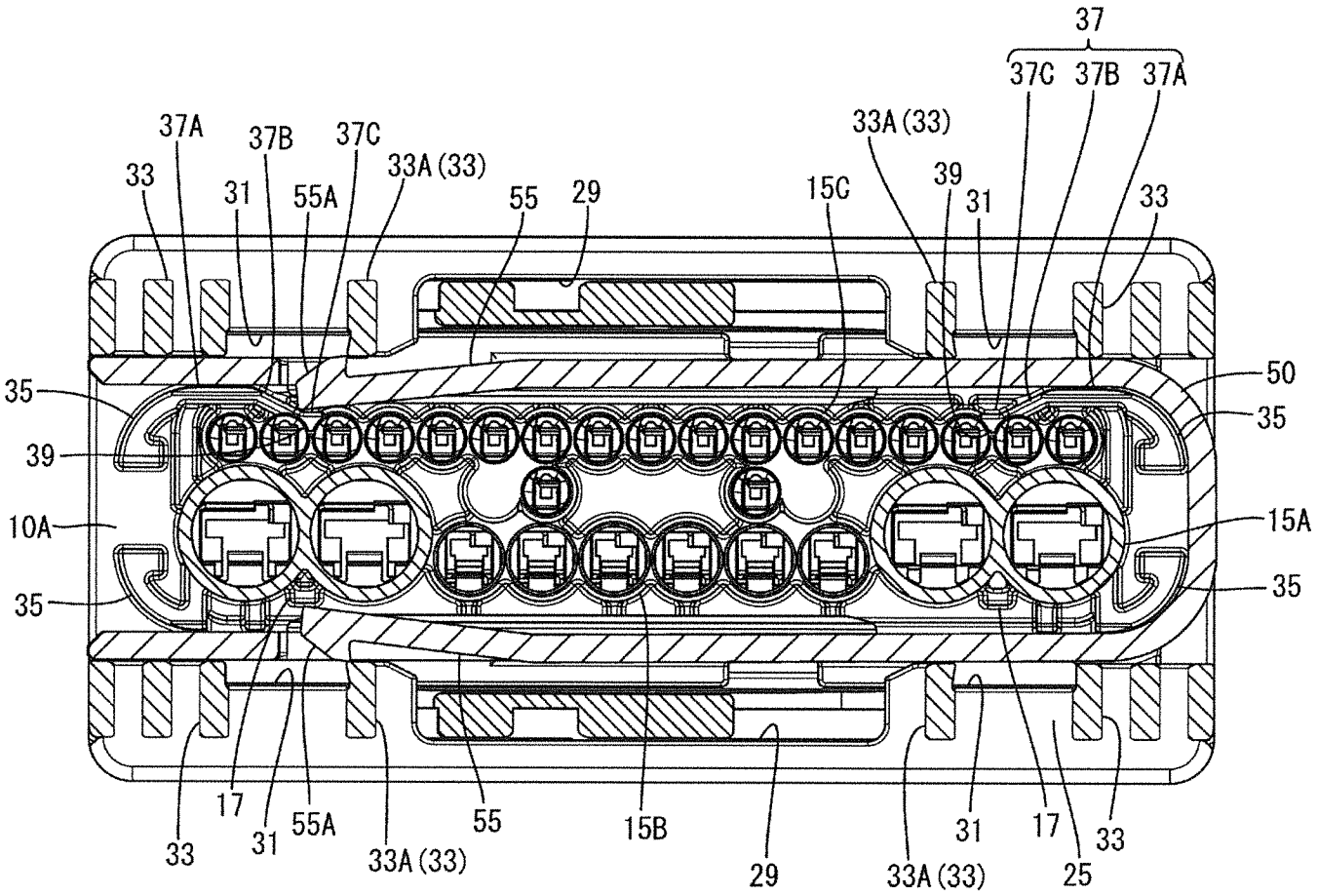
FIG. 16 is a section along A-A in FIG. 1 showing a state where the both locking pieces are unlocked.

Then, as shown in FIG. 16, the cover 50 is moved rightward with the both locking pieces 55 unlocked, and the locking projection 55 moves onto the upper projecting edge 33A on the central side to maintain an unlocked state. By moving the cover 50 farther rightward and pushing the locking piece 55 in the unlocking direction (inward) by the tool as appropriate from this state, the cover 50 is removed from the connector housing 10.

As described above, in this embodiment, even if the second locking piece 55 is pushed by the tool when only one locking piece 55 is unlocked and the cover 50 is inclined with respect to the connector housing 10, the locking piece 55 reliably comes into contact with the protection wall 37 and is not pushed any farther when being pushed to a degree more than specified. Thus, it is suppressed that the locking piece 55 is excessively deflected and broken. Further, since the protection wall 37 is integrated with the stopper 35 and the reinforcing rib 39, the strength of the protection wall 37 can be increased.

The specification is not limited to the above described and illustrated embodiment. For example, the following various modes are also included.

Although the protection wall 37 is integrated with the stopper portion 35 and the reinforcing rib 39 in the above embodiment, the protection wall 37 may be integrated with only either one of them or may be singly provided.

Although the cover 50 is mounted by being laterally slid with the guide portions 51 fit in the guide receiving portions 27 and the protruding portions 25 fit in the sliding grooves 53 in the above embodiment, the cover 50 may be mounted on the connector housing 10 by another method using a locking piece.

LIST OF REFERENCE SIGNS

10 . . . connector housing
10A . . . rear surface (cover mounting surface)
13 (13A to 13C) . . . cavity
15 (15A to 15C) . . . wire accommodating tube
25 . . . protruding portion (slide guide portion)
27 . . . guide receiving portion (slide guide portion)
31 . . . escaping portion
33 . . . projecting edge
33A . . . projecting edge on central side
35 . . . stopper
37 . . . protection wall
37A . . . coupling portion
37B . . . inclined portion
37C . . . reinforcing portion
39 . . . reinforcing rib
50 . . . cover
51 . . . guide
53 . . . sliding groove
55 . . . locking piece
55A . . . locking projection
C . . . connector

The invention claimed is:

1. A connector, comprising:

a connector housing provided with cavities for accommodating terminal fittings and connectable to a mating connector;

a cover configured to cover a wire pulled out from the connector housing by being mounted on a cover mounting surface side of the connector housing opposite to a connection surface;

locking pieces deflectably provided on both side surfaces of the cover and configured to lock the cover to the connector housing by projecting toward the connector housing;

locked portions provided on the connector housing and to be locked by the locking pieces; and a protection wall provided on the connector housing, the other locking piece coming into contact with the protection wall when being pushed in an unlocking direction when one of the locking pieces is unlocked and the cover is inclined with respect to the connector housing, the protection wall including an incline portion inclined to gradually increase a distance from the locked portion.

2. The connector of claim 1, wherein:

the connector housing includes a slide guide portion configured to slide and mount the cover in a direction intersecting with a connecting direction to the mating connector and a stopper portion configured to regulate an end position of a sliding movement and to be located inside the cover; and the protection wall is integrally provided to the stopper portion.

3. The connector of claim 2, wherein a plurality of wire accommodating tubes connected to the cavities are provided on the cover mounting surface of the connector housing, and the protection wall is integrated with a reinforcing rib provided to link between the wire accommodating tubes.

4. The connector of claim 1, wherein a plurality of wire accommodating tubes connected to the cavities are provided on the cover mounting surface of the connector housing, and the protection wall is integrated with a reinforcing rib provided to link between the wire accommodating tubes.

* * * * *